United States Patent [19]

Ohmura et al.

[11] 4,174,211

[45] Nov. 13, 1979

[54] PROCESS FOR MANUFACTURING COMPOSITE POWDER FOR POWDER METALLURGY

[75] Inventors: Taizo Ohmura, Ohmiya; Noboru Yonezawa, Urawa; Kazuo Ikuta, Kawagoe, all of Japan

[73] Assignee: Mitsubishi Kinzoku Kabushiki Kaisha, Tokyo, Japan

[21] Appl. No.: 894,336

[22] Filed: Apr. 7, 1978

[30] Foreign Application Priority Data

Apr. 23, 1977 [JP] Japan ..... 52-46349

[51] Int. Cl.[2] ..... B22F 9/00

[52] U.S. Cl. ..... 75/0.5 B; 75/0.5 BA; 75/0.5 BB; 75/0.5 BC

[58] Field of Search ..... 75/0.5 BC, 0.5 BB, 0.5 B, 75/0.5 BA

[56] References Cited

U.S. PATENT DOCUMENTS

| | | | |
|---|---|---|---|
| 2,969,281 | 1/1961 | Monson | 75/0.5 B |
| 3,311,464 | 3/1967 | Blomberg | 75/0.5 B |
| 3,318,684 | 5/1967 | Gernes et al. | 75/0.5 B |
| 3,652,259 | 3/1972 | Knopp | 75/0.5 B |

*Primary Examiner*—W. Stallard

*Attorney, Agent, or Firm*—Frishauf, Holtz, Goodman & Woodward

[57] ABSTRACT

A core metal in a molten state, which is to be pulverized, is put in a vessel in coexistence with a covering powder in a solid state consisting of a material which has a higher melting point than said core metal and is difficult to chemically react with said core metal and/or difficult to form a solid solution with said core metal. Then, said molten core metal and said solid covering powder are mixed thoroughly and uniformly by stirring. Then, while continuing said stirring, said molten core metal and said solid covering powder are slowly cooled until the temperature of the former reaches at least its solidus point to pulverize said core metal into a fine powder and to form a composite powder for powder metallurgy having a structure in which many particles of said covering powder adhere to and cover the entire surface of each particle of said fine powder of said core metal.

16 Claims, 1 Drawing Figure

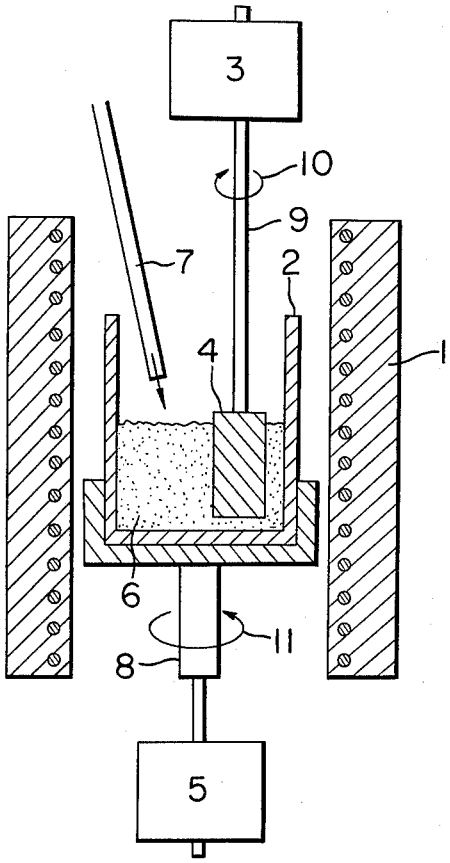
3
10
9
7
2
4
1
6
11
8
5

PROCESS FOR MANUFACTURING COMPOSITE POWDER FOR POWDER METALLURGY

REFERENCE TO PATENTS, APPLICATIONS AND PUBLICATIONS PERTINENT TO THE INVENTION

So far as we know, the only literature pertinent to the present invention is the U.S. patent application Ser. No. 857,886 titled "Process for Manufacturing Fine Powder of Metal" filed by us.

The contents of the prior art disclosed in the above-mentioned literature will be described later in the "Detailed Description of Preferred Embodiments".

FIELD OF THE INVENTION

The present invention relates to a process for manufacturing a composite power adapted to be used as a raw material powder of a sintered alloy to be produced by the conventional powder metallurgy process.

BACKGROUND OF THE INVENTION

In general, an alloy of the dispersion type such as a cermet in which the matrix of a metal contains a powder of a nonmetal or a powder of a different metal in uniform dispersion, is superior in the strength and the electro-chemical properties to an alloy of the melting type (i.e., a cast alloy) manufactured by the conventional melting process, and is therefore actively utilized in such special fields as a nuclear reactor fuel.

In the manufacture of an alloy of the melting type by the conventional melting process, however, it is particularly difficult to achieve uniform dispersion, in the matrix of a metal, of a powder of a nonmetal or a powder of a different metal having a largely different specific gravity from that of the metal forming said matrix. It is therefore usual practice in most cases to manufacture an alloy of the dispersion type mentioned above by the powder metallurgy process as a sintered alloy.

As is well known, the manufacture of a sintered alloy by the powder metallurgy process comprises sufficiently pulverizing and mixing raw material powders of elements constituting an alloy to be manufactured; pressing said raw material powders thus mixed to form a green compact of desired size and shape; and sintering said green compact. In an attempt to improve the sintering property and achieve a uniform chemical composition, a composite powder formed by covering the surface of each particle of a metallic powder or a nonmetallic powder with a different metal or a different nonmetal by a chemical, electro-chemical or mechanical method has become applied popularly, as a raw material powder for a sintered alloy, and the demand for the composite powder is only increasing.

There are conventionally known the following processes for manufacturing the aforementioned composite powder.

(a) A process comprising covering the surface of each particle of a metallic powder with a different metal by causing chemical precipitation of said different metal onto said surface;

(b) A process comprising covering the surface of each particle of a metallic powder or a nonmetallic powder with a different metal by electroplating said surface with said different metal;

(c) A process comprising covering the surface of each particle of a metallic powder with a different metallic powder or with a nonmetallic powder by grinding and mixing two different metallic powders in a ball mill or by grinding different metallic and mixing the metallic powder and the nonmetallic powder in a ball mill; and (d) A process, as an application of the hydrogen pressure reduction process, comprising covering the surface of each particle of a metallic powder with a different metal after activating said surface with the use of such a surfactant as anthraquinone.

However, the processes (a) and (b) mentioned above pose environmental control problems in the disposal of waste liquid, and the process (c) mentioned above usually requires a long time for manufacturing a composite powder. Also, the process (d) mentioned above, which is being adopted as a process for economically manufacturing a composite powder for certain alloys, causes pollution in the disposal of waste liquid. Furthermore, all the processes (a) to (d) mentioned above are identical in the basic step of using a metallic powder or a nonmetallic powder prepared in advance by a known method as the starting material powder and covering the surface of each particle of said powder with a different metal or with a different nonmetal, and hence cannot be a simple process for manufacturing a composite powder.

SUMMARY OF THE INVENTION

An object of the present invention is therefore to provide a process for manufacturing a fine composite powder, which is adapted to be used as a raw material powder of a sintered alloy to be produced by the powder metallurgy process, efficiently by easy operations and at low costs.

A principal object of the present invention is to provide a process for manufacturing a fine composite powder, which is adapted to be used a raw material powder of a sintered alloy to be produced by the powder metallurgy process, directly from a molten or semi-molten metal, without the use of a metallic powder prepared in advance as the starting material powder.

In accordance with one of the features of the present invention, there is provided a process for manufacturing a fine composite powder for powder metallurgy comprising a core metal powder and many particles of a covering powder adhering to the entire surface of each particle of said core metal powder, characterized by comprising the steps of:

putting a core metal in at least a semi-molten state, which is to be pulverized, in a vessel in coexistence with a covering powder in a solid state, said covering powder consisting of a material which has a higher melting point than said core metal and is difficult to chemically react with said core metal and/or difficult to form a solid solution with said core metal, said covering powder being selected in response to the chemical composition of a sintered alloy to be produced, and the temperature of said at least semi-molten core metal being lower than the melting point of said covering powder;

mixing said at least semi-molten core metal and said solid covering powder by stirring so as to ensure uniform dispersion of said solid covering powder in said at least semi-molten core metal; and then, slowly cooling said at least semi-molten core metal and said solid covering powder, while continuing said stirring, until the temperature of said at least semi-molten core metal reaches at least its solidus point, to pulverize said core metal into a fine powder and to form a composite powder for powder metallurgy having a structure in which many particles of said covering powder adhere to and cover the entire surface of each particle of said fine powder of said core metal.

BRIEF DESCRIPTION OF THE DRAWING

The attached drawing is a schematic longitudinal sectional view illustrating an embodiment of the apparatus for carrying out the process of the present invention.

DETAILED DESCRIPTION OF PREFERRED EMBODIMENTS

We have previously filed the U.S. patent application Ser. No. 857,886 titled "Process for manufacturing Fine Powder of Metal", which comprises the steps of:

putting a metal in at least a semi-molten state, which is to be pulverized, in a vessel in coexistence with an assistant-powder in a solid state, said assistant-powder consisting of a material which has a higher melting point than said metal and is difficult to chemically react with said metal and/or difficult to form a solid solution with said metal, and the temperature of said at least semi-molten metal being lower than the melting point of said assistant-powder; mixing said at least semi-molten metal and said solid assistant-powder by stirring so as to ensure uniform dispersion of said solid assistant-powder in said at least semi-molten metal; slowly cooling said at least semi-molten metal and said solid assistant-powder, while continuing said stirring, until the temperature of said at least semi-molten metal reaches at least its solidus point, to pulverize said metal into a fine powder and to form a composite powder having a structure in which many particles of said assistant-powder adhere to and cover the entire surface of each particle of said fine powder of said metal; and then, separating and removing said assistant-powder from said composite powder, thereby obtaining a fine powder of said metal (this process being hereinafter referred to as the "prior art").

According to the aforementioned prior art, it is possible to manufacture a fine powder of a metal having spherical or various irregular shapes, free from pores and surface oxidation and having relatively uniform particle sizes, adapted to be used as a raw material powder of a sintered alloy. It is therefore possible to manufacture a desired sintered alloy by blending and mixing fine powders of various metals, obtained by said prior art, in response to the chemical composition of the sintered alloy to be manufactured and applying the conventional powder metallurgy process to the mixed powders thus obtained.

However, as a result of our further study on said prior art, we have found that it is possible to use a composite powder, obtained as an interim product in said prior art, directly as a raw material powder of a sintered alloy without removing an assistant-powder adhering to the surface of said composite powder by properly selecting in advance a combination and a blending ratio of said metal and said assistant-powder so as to comply with the chemical composition of the sintered alloy to be manufactured.

The process of the present invention is described in detail below.

In the process of the present invention, a pure metal or an alloy in a molten or semi-molten state, which is to be pulverized and is to form a core of a composite powder to be manufactured (hereinafter generally referred to as "core metal"), is put in a vessel in coexistence with a covering powder in a solid state, which is to form a covering layer of said composite powder, by any of the following steps:

(a) Charging a solid core metal into a vessel, heating said core metal until said core metal reaches at least a semi-molten state (i.e., a state in which solid and liquid phases are coexisting), and then, adding a covering powder in a solid state to said core metal in at least a semi-molten state; or (b) Charging a solid core metal into a vessel together with a solid covering powder, and then, heating said solid core metal and said solid covering powder until said solid core metal reaches at least a semi-molten state; or (c) Charging a previously prepared core metal in at least a semi-molten state into a vessel, and then, adding a covering powder in a solid state to said at least semi-molten core metal; or (d) Following the steps of melting and refining a core metal in a vessel, adding a covering powder in a solid state to said core metal still in at least a semi-molten state in said vessel.

In the process of the present invention, the covering powder which is to form a covering layer of a composite powder to be manufactured must consist of a material which has a higher melting point than a core metal which is to form a core of said composite powder and is difficult to chemically react with said core metal and/or difficult to form a solid solution with said core metal. As the covering powder mentioned above, at least one powder is used, depending upon the kind of a core metal and the chemical composition of a sintered alloy to be manufactured, which is appropriately selected from the group consisting of:

(1) Powders of such oxides as MgO, $Al_2O_3$, $SiO_2$, $Fe_3O_4$, $Y_2O_3$, PbO and $ThO_2$;
(2) Powders of such carbides as TiC, $Mo_2C$, WC and $W_2C$;
(3) Powders of such nitides as TiN;
(4) Powders of such carbonitrides as Ti (C, N);
(5) Powders of such carbons as carbon black and graphite; and
(6) Powders of such metals as Al and Cu.

When said covering powder has a particle size of under about 0.001 μm, it scatters about in the form of dust, and this is not desirable for handling and health of workers. If its particle size exceeds about 10 μm, on the other hand, good results cannot be obtained in pulverizing a core metal. It is therefore desirable to keep the particle size of said covering powder within a range of from about 0.001 to about 10 μm.

Furthermore, the temperature of said molten or semi-molten core metal must be lower than the melting point of the aforementioned solid covering powder coexisting with said core metal.

Then, in the process of the present invention, said molten or semi-molten core metal and said solid covering powder coexisting in the vessel are mixed by stirring so as to ensure uniform disperson of said solid covering powder in said molten or semi-molten core metal.

The ratio of the covering powder to the core metal is largely dependent on such various factors as the kind of said core metal, the kind and the particle size of said covering powder and the chemical composition of the sintered alloy to be manufactured, and cannot therefore be generalized. However, it is necessry to use the covering powder in an amount sufficient to cover the entire surface of each of fine powder particles of the core metal pulverized as described later. For instance, when the core metal is a Pb-1% Ag alloy and the particle size of the covering powder, which is a $Fe_3O_4$ powder, ranges from about 1 to about 10 μm, it is desirable to use the covering powder in an amount of at least about 3 wt.% of said Pb-1% Ag alloy; when the core metal is aluminum and the covering powder, which is an $Al_2O_3$ powder, has an average particle size of about 0.001 μm, the desirable amount of the covering powder is at least about 3 wt.% of said aluminum; when the core metal is copper and the particle size of the covering powder, which is a carbon black powder, ranges from about 0.001 to about 0.01 μm, the amount of said covering powder should preferably be at least about 10 wt.% of said copper; and when the core metal is lead and the particle size of the covering powder, which is an aluminum powder, ranges from about 1 to about 10 μm, an amount of the covering powder of at least about 13 wt.% of said lead is preferable.

The aforementioned stirring of the molten or semi-molten core metal and the solid covering powder in the vessel may be achieved by mechanically or electromagnetically rotating or oscillating stirrer blades, or by mechanically or electromagnetically rotating or oscillating the vessel, or by a combination of these conventionally known means. Since the extent of said stirring is influenced by such various factors as the viscosity and volume of the molten or semi-molten core metal and the shape and size of the vessel and the stirrer blades, it is impossible to present one generally applicable extent of stirring. However, in the case where the stirring is carried out with a stirrer blade comprising a single plate, said stirrer blade may be rotated at a rate of at least about 100 r.p.m., or if the stirring is carried out by the oscillation of the vessel, it suffices to oscillate said vessel at a rate of at least about 100 times per minute.

Then, in the process of the present invention, said molten or semi-molten core metal and said solid covering powder are cooled slowly while continuing said stirring. It suffices to carry out said slow cooling until the temperature of said molten or semi-molten core metal reaches its solidus point. It is also desirable to carry out said cooling at a slow rate within a range of from 0.1 ° to 10° C. per minute in order to fully pulverize said molten or semi-molten core metal into a fine powder.

As a result of the above-mentioned stirring and slow cooling, said molten or semi-molten core metal is fully pulverized into a fine powder, and there is formed a composite powder of the present invention having a structure in which many particles of said covering powder adhere to and cover the entire surface of each particle of said fine powder of said core metal, said fine powder showing a range of particle size distribution of from about 10 to about 325 mesh (from about 1,651 to about 44 μm) (there are naturally some finer particles of under 325 mesh).

After the formation of said composite powder, it is desirable to prevent cohesion and sintering of said composite powder by immediately transferring it to another vessel for rapid cooling.

It is also desirable in the process of the present invention to carry out the aforesaid steps from the melting of said core metal to the completion of formation of said composite powder in a non-oxidizing atmosphere so that oxidation of said molten or semi-molten core metal, said covering powder and said composite powder manufactured may be avoided.

According to the aforementioned process of the present invention, it is possible to manufacture, by simple operations with a high efficiency and at lower costs, a composite powder adapted to be used as a raw material powder for powder metallurgy which has spherical or various irregular shapes, with relatively small particle sizes, and has an excellent compression formability. It is possible to obtain a composite powder which has further smaller particle sizes and shows a narrower range of particle size distribution by using a composite powder obtained by the process of the present invention as the starting material and by repeatedly applying to said composite powder the process of the present invention as follows:

(A) Charging a composite powder obtained by the process of the present invention (hereinafter referred to as the "primary composite powder") into a vessel, and adding a certain amount of the same covering powder in a solid state as that used for manufacturing said primary composite powder while stirring. The means and the extent of said stirring may be similar to those mentioned above.

The amount of the covering powder to be added is largely dependent on such various factors as the kind of the core metal, the kind and particle size of the covering powder of the primary composite powder and the chemical composition of the sintered alloy to be manufactured, and cannot therefore be generalized. However, because the fine powder of the core metal forming the core of the primary composite powder is further finely pulverized as described later, the total surface area of said fine powder increases considerably. It is therefore desirable to add further an amount of at least about 50% of the amount of the covering powder used for manufacturing the primary composite powder.

(B) Then, heating said primary composite powder and said added covering powder while continuing said stirring until each particle of the core metal powder forming the core of said primary composite powder reaches a molten or semi-molten state. The temperature of said heating should be lower than the melting point of said covering powder. Even after each particle of the core metal powder forming the core of said primary composite powder has reached a molten or semi-molten state, particles of said molten or semi-molten core metal powder never agglomerate together and never grow into larger particles, because particles of the first covering powder and the added covering powder in a solid state are present thoroughly and uniformly between particles of said molten or semi-molten core metal powder.

(C) Then, slowly cooling said molten or semi-molten core metal powder and said solid covering powder while continuing said stirring. It suffices to carry out said slow cooling until the temperature of said molten or semi-molten core metal powder reaches its solidus point. It is also desirable to carry out said cooling at a slow rate within a range of from 0.1° to 10° C. per minute in order to further finely pulverize each particle of said molten core metal powder forming the core of said primary composite powder.

(D) As a result of the above-mentioned stirring and slow cooling, each particle of said core metal powder forming the core of said primary composite powder is further finely pulverized into a finer powder and there is formed a final composite powder of the present invention having a structure in which many particles of said covering powder adhere to and cover the entire surface of each particle of the powder of said core metal thus further finely pulverized, said fine powder showing a tight range of particle size distribution mostly comprising particles with particles sizes ranging from about 200 to about 325 mesh (from about 74 to about 44 μm). A final composite powder with smaller particle sizes and a narrower range of particle size distribution can be obtained by repeating the afore-mentioned steps (A) to (C).

Similarly to the previous description, it is desirable to rapidly cool said final composite powder immediately after the formation of said final composite powder, and to carry out the steps from the heating of the core metal and the covering powder up to the completion of the final composite powder in a non-oxidizing atmosphere.

Now, the process of the present invention is described more in detail by means of examples with reference to the drawing.

EXAMPLE 1

An apparatus as shown in the schematic longitudinal sectional view of the attached drawing was employed, and 4,950 g of lead (Pb) lumps and 50 g of silver (Ag) lumps were charged into a graphite crucible 2 placed in an electric resistance furnace 1. Said crucible 2 is rotatable around a vertical shaft 8 driven by a motor 5. Said Pb and said Ag in said crucible 2 were then heated by said electric resistance furnace 1 to prepare a molten Pb-1% Ag Alloy 6 at temperature of about 600° C. as the core metal.

Then, at the moment when said molten Alloy 6 reached a semi-molten state, i.e., a state in which solidus and liquidus phases were coexisting, by lowering the temperature of said molten alloy 6 to 326° C., 200 g of $Fe_3O_4$ powder in a solid state having a particle size within a range of from about 1 to about 10 μm were added as the covering powder through a nozzle 7 to said semi-molten alloy 6, while stirring said semi-molten alloy 6 by rotating said crucible 2 in the arrow 11 direction at 10 r.p.m. through the vertical shaft 8 by the motor 5 simultaneously with the rotation of an alumina-coated stainless steel stirrer blade 4 rotatable through another vertical shaft 9 by a motor 3 for stirring in the arrow 10 direction at 250 r.p.m.

Said semi-molten alloy 6 and said solid $Fe_3O_4$ powder were then slowly cooled at a rate of about 0.1° C. per minute until the temperature of said semi-molten alloy 6 was lowered to its eutectic point temperature (304° C.), while continuing said stirring so as to ensure uniform dispersion of said solid $Fe_3O_4$ powder in said semi-molten alloy 6. And while continuing said stirring, said eutectic point temperature was kept at this level.

As a result of the aforementioned steps of stirring and slow cooling, said alloy 6 was fully pulverized into a fine powder, and there was obtained a composite powder of the present invention having a structure in which many particles of the $Fe_3O_4$ powder adhere to and cover the entire surface of each particle of the fine powder of said Pb-1% Ag alloy. The composite powder thus obtained was immediately transferred to another vessel for rapid cooling to prevent cohesion and sintering of said composite powder.

The steps from the melting of the Pb-1% Ag alloy up to the completion of formation of the composite powder as mentioned above were carried out in a non-oxidizing atmosphere formed by injecting argon gas through the nozzle 7. Stirring was effected more satisfactorily when the stirrer blade 4 was rotated in the opposite direction 10 to that 11 of the graphite crucible 2 as shown in the drawing. About 25% of the added $Fe_3O_4$ powder remained in quite the same shape as that at the time of addition without adhering to the particle surfaces of the Pb-1% Ag powder, and was easily separated from the composite powder by sieving with a 325 mesh screen.

The composite powder of the present invention thus obtained presented spherical or various irregular shapes, had a particle size distribution ranging from about 10 to about 325 mesh (from about 1,651 to about 44 μm) (there were naturally present some finer particles of under 325 mesh), with many of the particle sizes ranging from about 24 to about 240 mesh (from about 701 to about 61 μm). Almost no surface oxidation was observed in said composite powder. Said composite powder was well adapted to be used as a raw material powder for manufacturing a sintered lead alloy applied as a corrosion-preventive non-soluble anode.

EXAMPLE 2 with the use of the same apparatus as that employed in Example 1, i.e., that illustrated in the schematic longitudinal sectional view of the attached drawing, 500 g of aluminum (Al) lumps were charged as the core metal into a graphite crucible 2, and were heated by an electric resistance furnace 1 to prepare a molten Al at a temperature of about 680° C.

Then, at the moment when the temperature of said molten Al 6 was lowered to 665° C., 15 g of $Al_2O_3$ powder in a solid state having an average particle size of about 0.005 μm were added as the covering powder through a nozzle 7 to said molten Al 6, while stirring said molten Al 6 by rotating a stirrer blade 4 and said crucible 2 as in Example 1.

Said molten Al 6 and said solid $Al_2O_3$ powder were then slowly cooled at a rate of about 1° C. per minute until the temperature of said molten Al 6 was lowered to its solidus point temperature (659° C.), while continuing said stirring so as to ensure uniform dispersion of said solid $Al_2O_3$ powder in said molten Al 6. And while continuing said stirring, said solidus point temperature was kept at this level.

As a result of the aforementioned steps of stirring and slow cooling, said Al 6 was fully pulverized into a fine powder, and there was obtained a composite powder of the present invention having a structure in which many particles of the $Al_2O_3$ powder adhere to and cover the entire surface of each particle of the fine powder of said Al. The composite powder thus obtained was immediately transferred to another vessel for rapid cooling to prevent cohesion and sintering of said composite powder.

The steps from the melting of Al up to the completion of formation of the composite powder as mentioned above were carried out in a non-oxidizing atmosphere of argon gas, as in Example 1. All the particles of the added $Al_2O_3$ totally adhered to the particle surfaces of Al powder, not causing production of excessive $Al_2O_3$ powder.

The composite powder of the present invention thus obtained presented spherical or various irregular shapes mostly composed of composite powder particles with particle sizes ranging from about 150 to about 325 mesh (from about 104 to about 44 μm). Almost no surface oxidation was observed in said composite powder. Said composite powder was well adapted to be used as a raw material powder for manufacturing a sintered aluminum alloy.

Both in the case where a composite powder was manufactured under the manufacturing conditions shown in the table with the use of an Ni-20% Cr alloy as the core metal and a $ThO_2$ powder as the covering powder, and in the case where a composite powder was manufactured under the manufacturing conditions shown in the table with the use of Pb as the core metal and a PbO powder as the covering powder, there were obtained composite powders having excellent properties as a raw material powder of a sintered alloy as shown in the table.

EXAMPLE 3

Copper (Cu) lumps as the core metal in an amount of 200 g were charged into a bottom-closed silica tube with an inside diameter of 20 mmϕ, together with 20 g of carbon black powder in a solid state having a particle size within a range of from about 0.001 to about 0.01 μm as the covering powder. After filling said silica tube with argon gas under ⅓ atmospheric pressure, said silica tube was vertically charged into a heating furnace and heated to a temperature of about 1,150° C. to melt said Cu.

The, said molten Cu and said solid carbon black powder were slowly cooled at a rate of about 0.5° C. per minute until the temperature of said molten Cu was lowered to its solidus point temperature (1,083° C.), while stirring said molten Cu by vertically shaking said silica tube at a rate of 150 times per minute in said heating furnace, so as to ensure uniform dispersion of said solid carbon black powder in said molten Cu. And while continuing saidstirring, said solidus point temperature was kept at this level. With a view to achieving sufficient effects of said stirring, a plurality of projections were provided on the inner surface of said silica tube.

As a result of the aforementioned steps of stirring and slow cooling, said cu was fully pulverized into a fine powder, and there was obtained a composite powder of the present invention having a structure in which many particles of the carbon black powder adhere to and cover the entire surface of each particle of the fine powder of said Cu. The composite powder thus obtained was immediately transferred to another vessel for rapid cooling to preventcohesion and sintering of said composite powder.

The composite powder of the present invention thus obtained presented spherical or various irregular shapes, mostly composed of composite powder particles with particle sizes ranging from about 150to about 325 mesh (from about 104 to about 44 μm). Almost no surface oxidation was observed in said composite powder. Said composite powder was well adapted to be used as a raw material powder for manufacturing a sintered alloy for metal-graphite brushes.

Also in the case where a composite powder was manufactured under the manufacturing conditions shown in the table with the use of silver (Ag) as the core metal and a carbon black powder as the covering powder, the composite powder obtained had the properties as shown in the table and was a raw material powder adapted to be used for manufacturing a sintered alloy for electrical contacts.

EXAMPLE 4

Lead (Pb) lumps as the core metal in an amount of 150 g were charged into a silica tube identical with that used in Example 3 above, together with 20 g of aluminum (Al) powder in a solid state having a particle size within a range of from about 1 to about 10 μm as the covering powder. After filling said silica tube with argon gas under ⅓ atmospheric pressure, said silica tube was vertically charged into a heating furnace and heated to a temperature of 350° C. to melt said Pb.

Said molten Pb and said solid Al powder were then slowly cooled at a rate of about 0.5° C. per minute until the temperature of said molten Pb was lowered to its solidus point temperature (327° C.), while stirring said molten Pb by vertically shaking said silica tube at a rate of 200 times per minute in said heating furnace, so as to ensure uniform dispersion of said solid Al powder in said molten Pb. And while continuing said stirring, said solidus point temperature was kept at this level.

As a result of the aforementioned steps of stirring and slow cooling, said Pb was fully pulverized into a fine powder, and there was obtained a composite powder of the present invention having a structure in which many particles of the Al powder adhere to and cover the entire surface of each particle of the fine powder of said Pb. The composite powder thus obtained was immediately transferred to another vessel for rapid cooling to prevent cohesion and sintering of said composite powder.

The composite powder of the present invention thus obtained presented spherical or various irregular shapes, mostly composed of composite powder particles with particle sizes ranging from about 150 to about 325 mesh (from about 104 to about 44 μm). Almost no surface oxidation was observed in said composite powder. Said composite powder was well adapted to be used as a raw material powder for manufacturing a sintered alloy.

Also in the case where a composite powder was manufactured under the manufacturing conditions shown in the table with the use of Pb as the core metal and Cu powder as the covering powder, the composite powder obtained had the properties shown in the table and was a raw material powder adapted to be used for manufacturing a sintered lead alloy.

According to the process of the present invention, as described above in detail, it is possible to efficiently manufacture by simple operations at lower costs directly from a molten or semi-molten metal a fine composite powder adapted to be used as a raw material powder of a sintered alloy to be produced by the powder metallurgy process, which has spherical or various irregular shapes with almost uniform particle sizes and other excellent properties substantially free from surface oxidation, thus providing industrially useful effects.

TABLE

| Core metal | | Covering powder | | | Manufacturing conditions | | Properties of composite powder obtained | |
|---|---|---|---|---|---|---|---|---|
| Kind | Blending (g) | Kind | size (μm) | Blending (g) | Cooling rate (°C./minute) | Composite powder formation temp. (°C.) | Shape | Particle size (μm) |
| Ni-20% Cr | 500 | $ThO_2$ | 0.01 to 0.1 | 10 | 0.5 | 1,460 to 1,420 | Substantially spherical | 44 to 147 |

TABLE-continued

| Core metal | | Covering powder | | | Manufacturing conditions | | Properties of composite powder obtained | |
|---|---|---|---|---|---|---|---|---|
| Kind | Blending (g) | Kind | size (μm) | Blending (g) | Cooling rate (°C./minute) | Composite powder formation temp. (°C.) | Shape | Particle size (μm) |
| Pb | 1,000 | PbO | 1 to 10 | 40 | 0.5 | 335 to 326 | Substantially spherical | 61 to 351 |
| Ag | 200 | C | 0.01 to 0.1 | 10 | 0.5 | 965 to 959 | Substantially spherical | 44 to 147 |
| Pb | 150 | Cu | 1 to 10 | 5 | 0.5 | 335 to 326 | Substantially spherical | 61 to 351 |

what is claimed is:

1. A process for manufacturing a fine composite powder for powder metallurgy comprising a core metal powder and many particles of a covering powder adhering to the entire surface of each particle of said core metal powder, characterized by comprising the steps of:

putting a core metal in at least a semi-molten state, which is to be pulverized, in a vessel in coexistence witha covering powder in a solid state, said covering powder consisting of a materialwhich has a higher melting point than said core metal and is difficult to chemically react with said core metal and/or difficult to form a solid solutionwith said core metal, said covering powder being selected in response to the chemical composition of a sintered alloy to be produced, and the temperature of said at least semi-molten core metal being lower than the melting point of said covering powder;

mixing said at least semi-molten core metal and said solid covering powder by stirring so as to ensure uniform dispersion of said solid covering powder in said at least semi-molten core metal; and then, slowly cooling said at least semi-molten core metal and said solid covering powder, while continuing said stirring, until the temperature of said at least semi-molten core metal reaches at least its solidus point, to pulverize said core metal into a fine powder and to form a composite powder for powder metallurgy having a structure in which many particles of said covering powder adhere to and cover the entire surface of each particle of said fine powder of said core metal.

2. The process as claimed in claim 1, wherein said covering powder has a particle size within a range of from about 0.001 to about 10 um and comprises at least one powder selected from the group consisting of:

(1) MgO, $Al_2O_3$, $SiO_2$, $Fe_3O_4$, $Y_2O_3$, PbO, and $ThO_2$ powder;

(2) TiC, $Mo_2C$, WC, and $W_2C$ powder;

(3) TiN powder;

(4) Ti (C,N) powder;

(5) carbon black and graphite powder; and (6) Al, and Cu powder.

3. The process as claimed in claim 1, wherein said slow cooling is conducted at a cooling rate within a range of from 0.1 to 10° C. per minute.

4. The processas claimed in claim 1, wherein said core metal in a solid state is charged into said vessel, and said core metal is heated until said core metal reaches at least a semi-molten state, and then, said covering powder in a solid state is added to said at least semi-molten core metal, thereby achieving the coexistence of said at least semi-molten core metal and said solid covering powder in said vessel.

5. The process as claimed in claim 1, wherein said core metal in a solid state is charged into said vessel together with said covering powder in a solid state, and then, said core metal and said covering powder are heated until said core metal reaches at least a semi-molten state, thereby achieving the coexistence of said at least semi-molten core metal and said solid covering powder in said vessel.

6. The process as claimed in claim 1, wherein said core metal in at least semi-molten state is charged into said vessel, and then, said covering powder in a solid state is added to said at least semi-molten core metal, thereby achieving the coexistence of said at least semi-molten core metal and said solid covering powder in said vessel.

7. The process as claimed in claim 1, wherein, following the melting and refining steps of said core metal in said vessel, said covering powder in a solid state is added to said core metal still in at least semi-molten state in said vessel, thereby achieving the coexistence of said at least semi-molten core metal and said solid covering powder in said vessel.

8. The process as claimed in claim 1, wherein a composite powder manufactured in compliance with claim 1 is used as said core metal.

9. The process as claimed in claim 1, wherein a Pb-1% Ag alloy is used as said core metal and a $Rd_3O_4$ powder is used as said covering powder.

10. The process as claimed in claim 1, wherein Al is used as said core metal and a $Al_2O_3$ powder is used as said covering powder.

11. The process as claimed in claim 1, wherein a Ni-20% Cr alloy is used as said core metal and a $ThO_2$ powder is used as said covering powder.

12. The process as claimed in claim 1, wherein Pb is used as said core metal and a PbO powder is used as said covering powder.

13. The process as claimed in claim 1, whereinCu is used as said core metal and a carbon black powder is used as said covering powder.

14. The process as claimed in claim 1, wherein Ag is used as said core metal and a carbon black powder is used as said covering powder.

15. The process as claimed in claim 1, wherein Pb is used as said core metal and a Al powder is used as said covering powder.

16. The process as claimed in claim 1, wherein Pb is used as said core metal and a Cu powder is used as said covering powder.

* * * * *

UNITED STATES PATENT AND TRADEMARK OFFICE

CERTIFICATE OF CORRECTION

PATENT NO. : 4,174,211

DATED : November 13, 1979

INVENTOR(S) : TAIZO OHMURA et al

It is certified that error appears in the above-identified patent and that said Letters Patent are hereby corrected as shown below:

1) Column 1, line 18: after "composite", replace "power" with ---powder---.

2) Columns 9-10, TABLE: under "Covering powder", replace "size μm" with ---Particle size μm---.

3) Column 12, line 42 (Claim 9): replace "$Rd_3O_4$ powder" with ---$Fe_3O_4$ powder---.

Signed and Sealed this

*Twenty-second* Day of *July 1980*

[SEAL]

*Attest:*

SIDNEY A. DIAMOND

*Attesting Officer*

*Commissioner of Patents and Trademarks*